US009611631B2

(12) United States Patent
Rosko

(10) Patent No.: US 9,611,631 B2
(45) Date of Patent: Apr. 4, 2017

(54) REMOVABLE POP-UP STRAINER

(71) Applicant: Delta Faucet Company, Indianapolis, IN (US)

(72) Inventor: Michael Scot Rosko, Greenwood, IN (US)

(73) Assignee: Delta Faucet Company, Indianapolis, IN (US)

( * ) Notice: Subject to any disclaimer, the term of this patent is extended or adjusted under 35 U.S.C. 154(b) by 110 days.

(21) Appl. No.: 14/466,329

(22) Filed: Aug. 22, 2014

(65) Prior Publication Data

US 2016/0053472 A1 Feb. 25, 2016

(51) Int. Cl.
*E03C 1/262* (2006.01)
*E03C 1/23* (2006.01)

(52) U.S. Cl.
CPC ..... *E03C 1/262* (2013.01); *E03C 1/2302* (2013.01)

(58) Field of Classification Search
CPC ..... E03C 1/262; E03C 1/2302; E03C 1/26; E03C 1/264; E03C 1/282
See application file for complete search history.

(56) References Cited

U.S. PATENT DOCUMENTS

| | | | | |
|---|---|---|---|---|
| 769,001 | A | 8/1904 | Lawrence | |
| 2,698,441 | A | 1/1955 | Shobe | |
| 3,596,294 | A | 8/1971 | Hoffman | |
| 3,802,001 | A | 4/1974 | Richards | |
| 3,911,508 | A | 10/1975 | Goldberg | |
| 3,959,831 | A | 6/1976 | Hendricks | |
| 4,045,351 | A | 8/1977 | Peterson | |
| 4,164,048 | A * | 8/1979 | Kampfer | E03C 1/282 137/247.41 |
| 4,380,834 | A | 4/1983 | Wentz | |
| 4,571,751 | A | 2/1986 | Barlow | |
| 5,165,118 | A | 11/1992 | Cendrowski | |
| 5,724,684 | A | 3/1998 | Paar | |
| 6,058,526 | A | 5/2000 | Parisi et al. | |
| 6,067,669 | A | 5/2000 | Peterson et al. | |
| 6,088,844 | A | 7/2000 | Killham | |
| 6,108,828 | A | 8/2000 | Cheng | |
| 6,145,136 | A | 11/2000 | Parisi et al. | |
| 7,013,500 | B1 | 3/2006 | Lin | |
| 7,442,296 | B2 | 10/2008 | Chong et al. | |
| 7,625,488 | B2 | 12/2009 | Blackburn | |
| 7,704,386 | B2 | 4/2010 | Ventura | |
| 8,011,030 | B2 | 9/2011 | Li | |
| 8,079,098 | B2 | 12/2011 | Thomas | |
| 8,136,179 | B2 | 3/2012 | Li et al. | |
| 8,214,942 | B2 | 7/2012 | Yang et al. | |
| 8,370,970 | B2 | 2/2013 | Reavis | |
| 8,407,828 | B2 | 4/2013 | Vogel et al. | |
| 8,590,065 | B2 | 11/2013 | Ali et al. | |
| 2004/0255378 | A1 | 12/2004 | Tracy | |
| 2009/0271919 | A1 | 11/2009 | Scorvo | |
| 2010/0000011 | A1 | 1/2010 | Angarita | |

(Continued)

*Primary Examiner* — Janie Loeppke
(74) *Attorney, Agent, or Firm* — Faegre Baker Daniels LLP

(57) ABSTRACT

A drain stopper assembly for a drain pipe of a sink basin includes a screen removably coupled to a plunger head and configured to block debris from passing into the drain pipe when the plunger head is in the raised position. The screen illustratively includes an annular support collar, and a plurality of circumferentially spaced fingers extending downwardly from the support collar.

19 Claims, 5 Drawing Sheets

(56) References Cited

U.S. PATENT DOCUMENTS

| | | | |
|---|---|---|---|
| 2011/0126347 | A1 | 6/2011 | Qian et al. |
| 2011/0185494 | A1 | 8/2011 | Beck et al. |
| 2013/0185855 | A1 | 7/2013 | Ali et al. |
| 2014/0007334 | A1 | 1/2014 | Golibart |

* cited by examiner

REMOVABLE POP-UP STRAINER

BACKGROUND AND SUMMARY OF THE DISCLOSURE

The present disclosure relates generally to drain assemblies for a basin, and more particularly, to a drain stopper assembly including a screen removably coupled to a plunger head of a drain plunger.

Conventional bathroom sink basins typically include a pop-up drain assembly having a stopper or plunger that is vertically moveable between a sealed position and an open position for draining water from the bottom of the sink basin. The plunger may be moved between raised and lowered positions by actuating a lever arm which is operably coupled to a lift rod accessible to a user from above the sink deck.

Conventional pop-up drain assemblies may permit items, such as jewelry, contact lenses and other foreign objects, to unintentionally pass through the drain, often making it necessary to disassemble the pipes located beneath the sink deck in order to retrieve the desired item. There is also a risk that the items may not be recovered from the under sink plumbing and potentially lost. While it is known to provide a strainer beneath a stopper in a bathroom sink, such strainers may be complicated and/or difficult to access for installation, cleaning and replacement.

According to an illustrative embodiment of the present disclosure, a drain stopper assembly for a drain pipe of a basin includes a plunger head having a seal to sealingly engage a drain pipe when in a lowered position and to allow passage of fluid when in a raised position. A plunger body is coupled to the plunger head and is configured to move with the plunger head between the lowered position and the raised position. A lever arm is operably coupled to the plunger body and is configured to move the plunger body and the plunger head from the lowered position to the raised position. A screen is removably coupled to the plunger head and is configured to block debris from passing into the drain pipe when the plunger head is in the raised position. The screen includes an annular support collar, and a plurality of circumferentially spaced fingers extending downwardly from the support collar. Each of the plurality of fingers includes an upper end coupled to the support collar, and a lower end freely suspended below the upper end.

According to another illustrative embodiment of the present disclosure, a removable screen for a pop-up drain assembly includes an annular support collar including a split ring to frictionally engage an outer surface of a plunger head. A plurality of circumferentially spaced flexible fingers extend downwardly from the support collar. Each of the plurality of fingers includes an upper end coupled to the support collar, and a lower end freely suspended below the upper end. The support collar and the flexible fingers are integrally formed of a polymer.

According to a further illustrative embodiment of the present disclosure, a drain stopper assembly for a drain pipe of a basin includes a plunger head having a seal to sealingly engage a drain pipe when in a lowered position and to allow passage of fluid when in a raised position. A plunger body is coupled to the plunger head and is configured to move with the plunger head between the lowered position and the raised position. A lever arm is operably coupled to the plunger body and is configured to move the plunger body and the plunger head from the lowered position to the raised position. A screen is removably coupled to the plunger head and is configured to block debris from passing into the drain pipe when the plunger head is in the raised position. The screen is formed of a polymer and includes an annular support collar having a split ring to frictionally engage an outer surface of a plunger head, and a plurality of circumferentially spaced fingers extending downwardly from the support collar. Each of the plurality of fingers includes an upper end coupled to the support collar, and a lower end freely suspended below the upper end.

Additional features and advantages of the present invention will become apparent to those skilled in the art upon consideration of the following detailed description of the illustrative embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
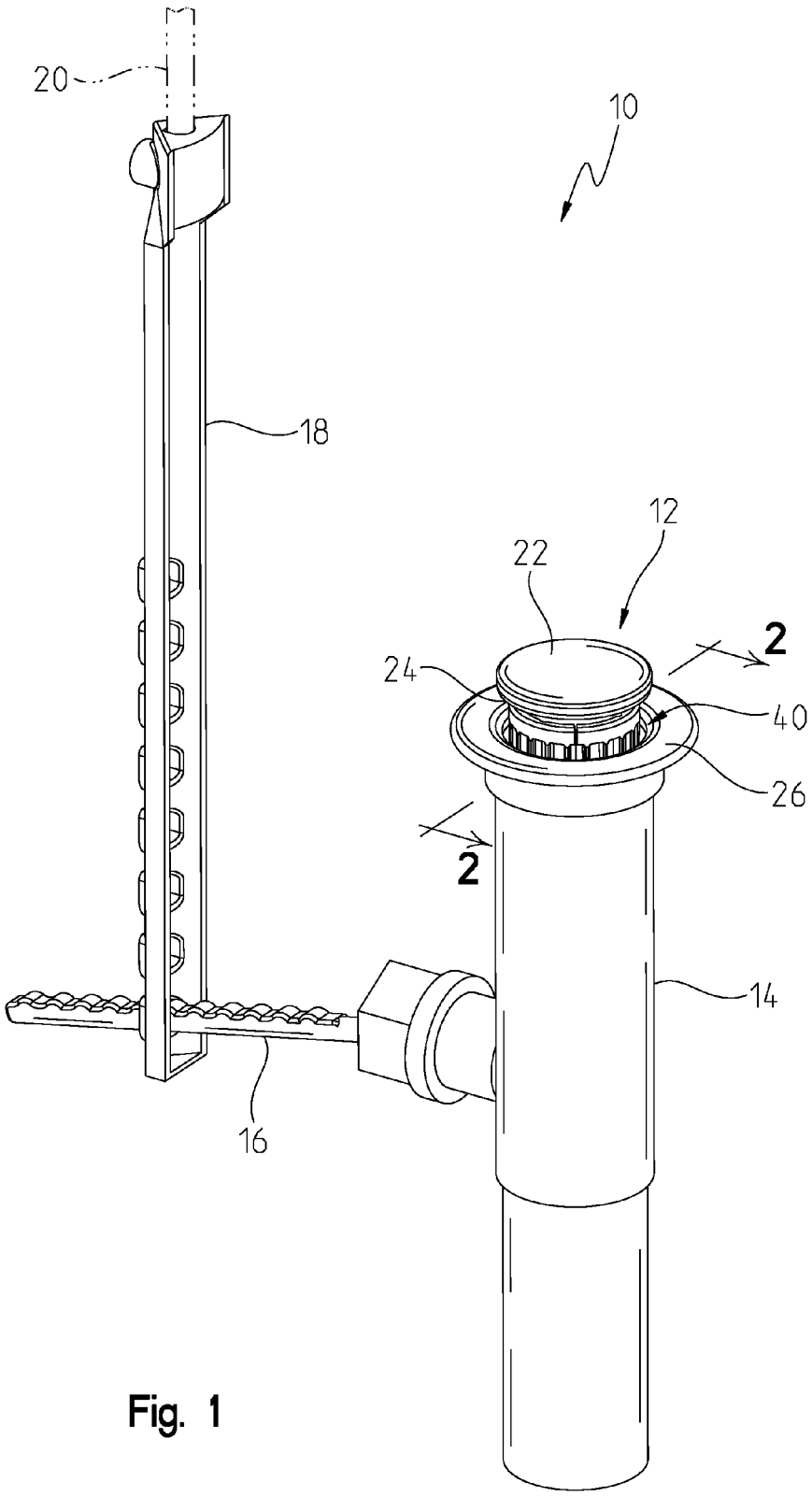
FIG. 1 is a perspective view of an illustrative drain assembly of the present disclosure.

Referring initially to FIG. 1, a drain assembly 10 is shown as including a plunger assembly 12 moveably received within a drain pipe 14. The drain pipe 14 is illustratively supported within the bottom of a sink basin 15. The plunger assembly 12 is illustratively configured for vertical movement as controlled by a pivotable lever arm 16, which is operably coupled to a control arm 18. A lift rod 20 may be coupled to the upper end of the control arm 18 for manipulation by a user from above a sink deck (not shown). More particularly, a user raising/lowering the lift rod 20 will raise/lower the control arm 18, causing pivoting movement of the lever arm 16, and subsequent lowering/raising of the plunger assembly 12 between the raised position of FIG. 2A and the lowered position of FIG. 2B.

Figure 2A:
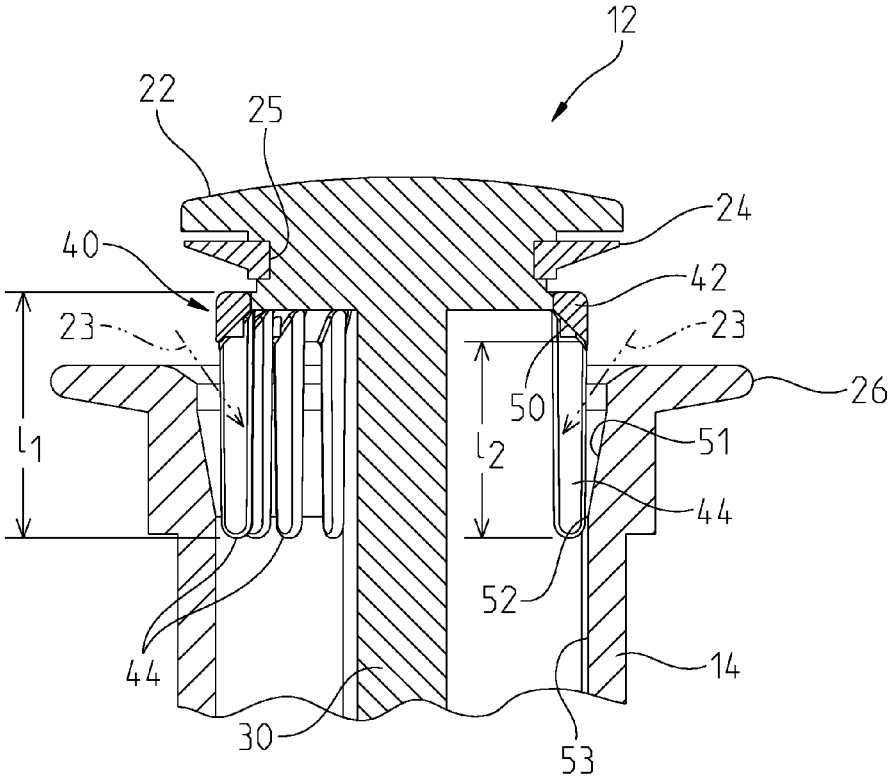
FIG. 2A is a cross-sectional view of the drain assembly of FIG. 1, showing the plunger assembly in a raised position within a drain pipe.
Figure 2B:
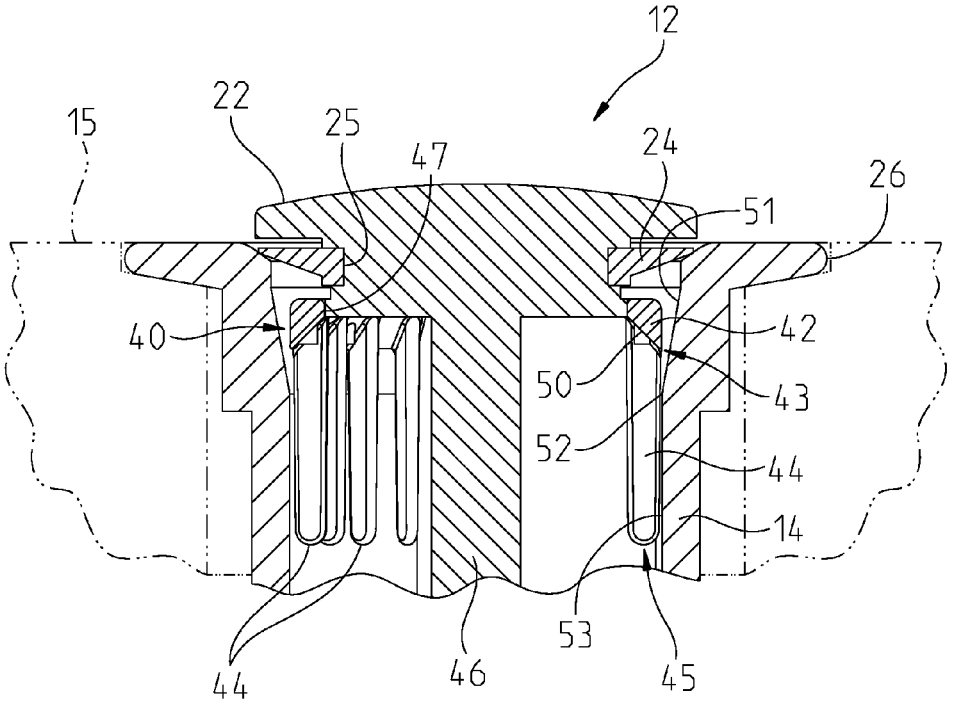
FIG. 2B is a cross-sectional view similar to FIG. 2A, showing the plunger assembly in a lowered position to seal against the flange of the drain pipe.
Figure 3:
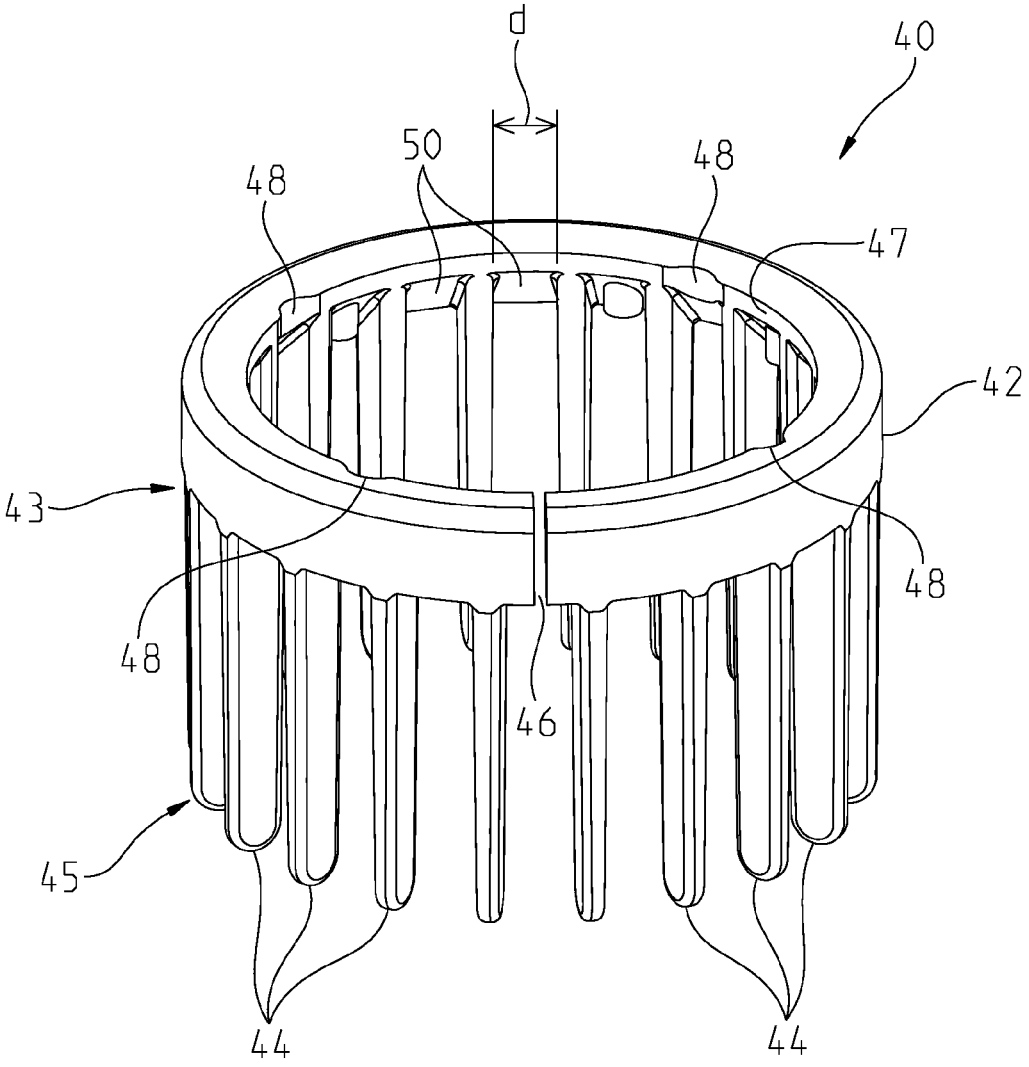
FIG. 3 is a perspective view of an illustrative screen of the present disclosure.
Figure 4:
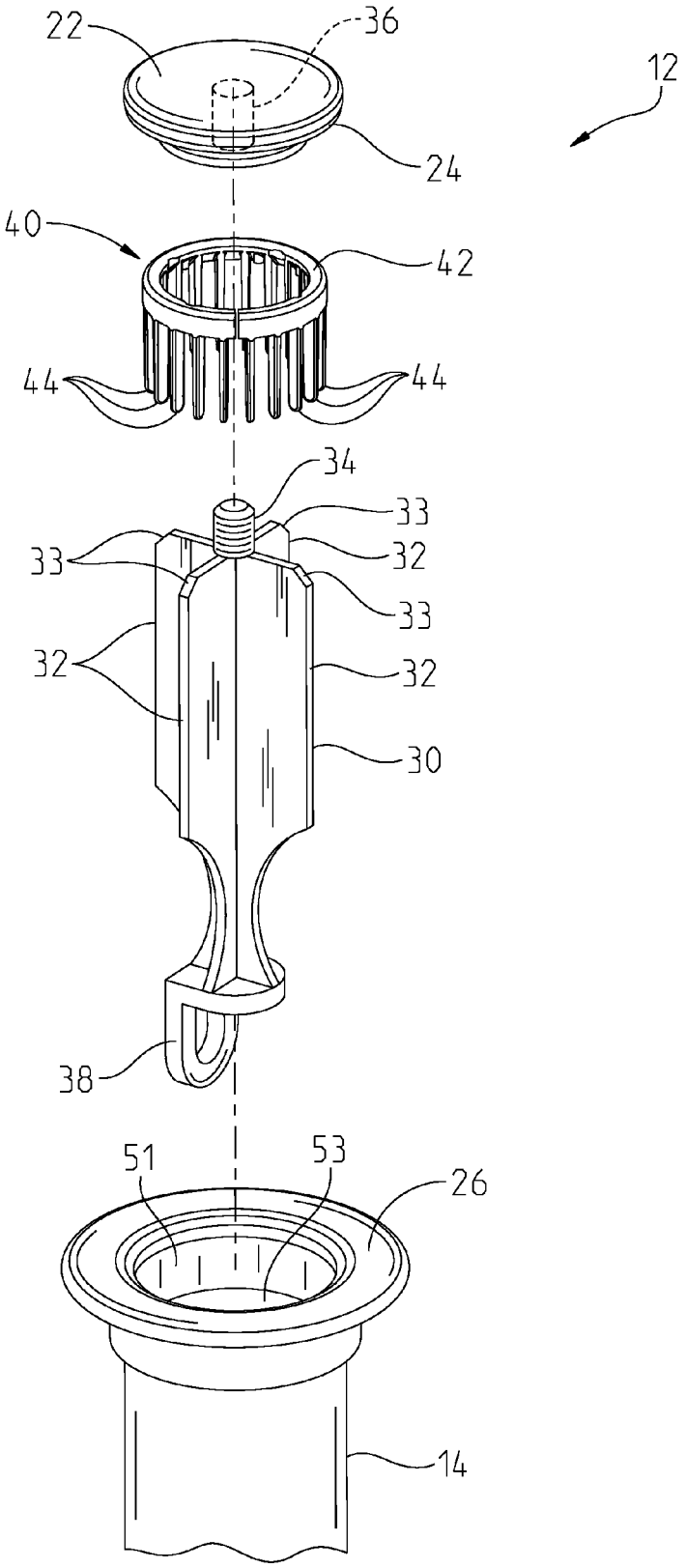
FIG. 4 is an exploded perspective view of the plunger assembly and drain pipe of FIG. 1.
Figure 5:
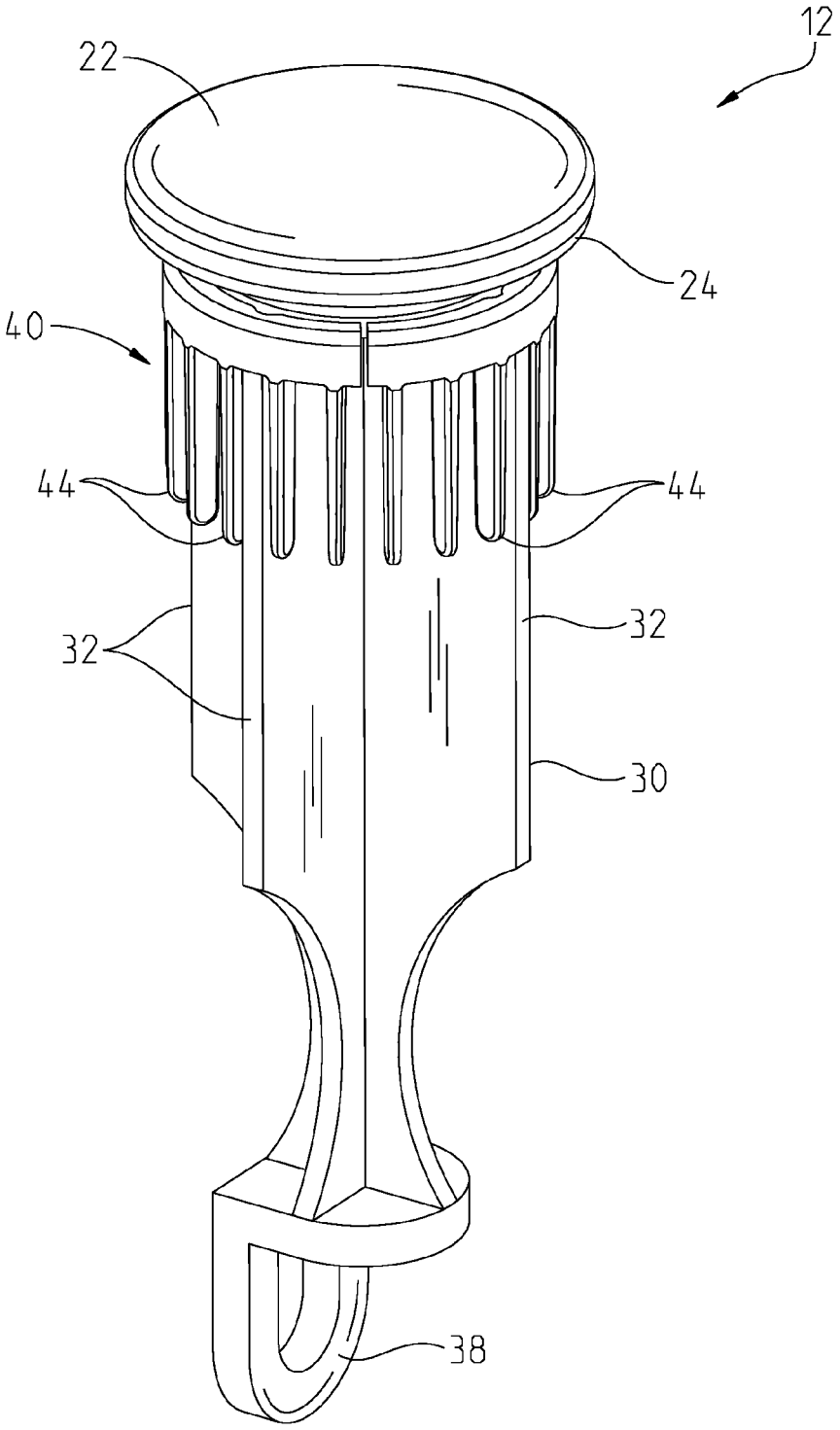
FIG. 5 is a perspective view of the plunger assembly of FIG. 4.

The plunger assembly 12 may be of conventional design and illustratively includes a plunger head 22 supporting a seal 24 to sealingly engage with a flange 26 of the drain pipe 14 when in the lowered position of FIG. 2B, and to allow passage of fluid (e.g., water) when in the raised position of FIG. 2A (water flow is represented by arrows 23 in FIG. 2A). The plunger head 22 is illustratively disc shaped and includes an annular groove 25 for receiving the seal 24. The plunger head 22 may be formed of a variety of materials, such as metal (e.g., stainless steel) or a polymer (such as a metal plated acetal).

The seal 24 may be of conventional design, such as an elastomeric o-ring. In another illustrative embodiment, the seal 24 may be a flexible lip seal formed of an elastomer and configured to sealingly conform to the flange 26 when the plunger head 22 is in the lowered position of FIG. 2B.

A plunger body 30 is coupled to the plunger head 22 and is configured to move with the plunger head 22 between the raised position (FIG. 2A) and the lowered position (FIG. 2B). The plunger body 30 illustratively includes a plurality of radially extending fins or blades 32, each including an angled upper surface 33.

In one illustrative embodiment, the plunger body 30 may be integrally molded from a polymer (e.g., acetal) with the plunger head 22. Alternatively, the plunger body 30 may be removably coupled to the plunger head 22 through a conventional connection, such as a threaded post 34 of the plunger body 30 received within a threaded opening 36 of the plunger head 22. Other removable coupling mechanisms may also be utilized, such as bayonet couplings, magnetic connections, etc.

The lever arm 16 is operably coupled to a lower loop 38 of the plunger body 30. In one illustrative embodiment, a distal end of the lever arm 16 is positioned below the loop 38 such that the lever arm 16 is configured to raise the plunger assembly 12. When the distal end of the lever arm 16 is lowered in such a configuration, water within the sink basin 15 causes the plunger assembly 12 to lower due to gravity. In another illustrative embodiment, the distal end of the lever arm 16 is received within the loop 38 and is configured to both raise and lower the plunger assembly 12.

A screen or strainer 40 is removably coupled to the plunger assembly 12 and is configured to block items greater than a certain size from passing into the drain pipe 14 when the plunger head 22 is in the raised position (FIG. 2A). The screen 40 illustratively includes an annular support collar 42, and a plurality of circumferentially spaced fingers 44 extending downwardly from the support collar 42. The screen 40 is illustratively formed of a polymer, such as a polypropylene.

The support collar 42 may include a slot 46 to define a split ring, thereby facilitating installation and removal of the screen 40 to the plunger head 22. More particularly, the split ring support collar 42 may be installed and removed by flexing it open relative to the plunger head 22. In alternative embodiments, the support collar 42 may be continuous (i.e., no slot 46) when the plunger head 22 is removably coupled to the plunger body 30. In other words, the plunger head 22 may be removed from the plunger body 30 when installing or removing the screen 40.

Each of the plurality of fingers 44 includes an upper end 43 coupled to the support collar, and a lower end 45 freely supported below the upper end 45. In other words, the upper ends 45 are interconnected by the support collar 42. In contrast, the lower ends 45 are not directly connected but freely supported relative to each other. As such, the lower ends 45 may move independent of each other. In order to effectively screen items while not unnecessarily impeding water flow, the fingers 44 are circumferentially spaced apart by distance "d", illustratively 0.1 inches.

An inner surface 47 of the support collar 42 frictionally engages the plunger head 22 to retain the screen 40 in position. A plurality of recesses or notches 48 of the screen 40 are aligned with the fins 32 of the plunger body 30 for rotational orientation therebetween. Inwardly facing inclined surfaces 50 of the support collar 42 face the angled upper surfaces 33 of the fins 32.

In the illustrative embodiment, the fingers 44 are configured to move vertically within the drain pipe 14 between a tapered upper portion 51 and a lower portion 53. The upper portion 51 has an inner diameter (major diameter) greater than the inner diameter (minor diameter) of the lower portion 53. The upper portion 51 transitions to the lower portion 53 at a transition point 52. In the illustrative embodiment, the fingers 44 are configured to maintain contact with the minor diameter of the lower portion 53 at the transition point 52 as the plunger body 12 moves between the raised and lowered positions. As such, the length of the fingers 44 are illustratively defined by dimensions $1_1$ and $1_2$, illustratively 0.75 inches and 0.6 inches, respectively.

Although the invention has been described in detailed with reference to certain preferred embodiments, variations and modifications exist within the spirit and scope of the invention as described and defined in the following claims.

The invention claimed is:

1. A drain stopper assembly for a drain pipe of a basin, the drain stopper comprising:

a plunger head including a seal to sealingly engage a drain pipe when in a lowered position and to allow passage of fluid when in a raised position;

a plunger body coupled to the plunger head and configured to move with the plunger head between the lowered position and the raised position;

a lever arm operably coupled to the plunger body and configured to move the plunger body and the plunger head from the lowered position to the raised position; and a screen removably coupled to the plunger head and configured to block debris from passing into the drain pipe when the plunger head is in the raised position, the screen including an annular support collar, and a plurality of circumferentially spaced flexible fingers extending downwardly from the support collar, each of the plurality of fingers including an upper end coupled to the support collar, and a lower end freely suspended below the upper end and the support collar, such that the lower ends are configured to move independently of each other.

2. The drain stopper assembly of claim 1, wherein the screen is formed of a polymer.

3. The drain stopper assembly of claim 1, wherein the lower ends of adjacent fingers are circumferentially spaced apart by 0.1 inches.

4. The drain stopper assembly of claim 1, wherein the support collar comprises a split ring to frictionally engage an outer surface of the plunger head.

5. The drain stopper assembly of claim 4, wherein the support collar may be flexed open at a slot to facilitate installation and removal for the screen on the plunger head.

6. The drain stopper assembly of claim 1, wherein the drain pipe includes an upper portion having a major diameter and a lower portion having a minor diameter, and each finger includes a length from the upper end to the lower end, the length being sufficient to vertically overlap with the minor diameter surface of the drain pipe when the plunger head is in both the lowered position and the raised position.

7. The drain stopper assembly of claim 6, wherein each finger includes a length from the upper end to the lower end of 0.6 inches.

8. The drain stopper assembly of claim 1, wherein the plunger body includes a plurality of fins, and the support collar includes a plurality of notches cooperating with the plurality of fins.

9. A removable screen for a pop-up drain assembly, the screen comprising:

an annular support collar including a split ring to frictionally engage an outer surface of a plunger head;

a plurality of circumferentially spaced flexible fingers extending downwardly from the support collar, each of the plurality of fingers including an upper end coupled to the support collar, and a lower end freely suspended below the upper end and the support collar; and the support collar and the flexible fingers integrally formed of a polymer.

10. The removable screen of claim 9, wherein the lower ends of adjacent fingers are circumferentially spaced apart by 0.1 inches.

11. The removable screen of claim 10, wherein each finger includes a length from the upper end to the lower end of 0.6 inches.

12. The removable screen of claim 9, wherein the support collar includes a plurality of notches cooperating with a plurality of fins of a stopper body.

13. The removable screen of claim 9, wherein the support collar and the flexible fingers are molded from a polypropelyne.

14. The drain stopper assembly of claim 9, wherein the support collar may be flexed open at a slot to facilitate installation and removal for the screen on the plunger head.

15. A drain stopper assembly, the drain stopper assembly comprising:

a drain pipe of a basin, the drain pipe including an upper portion having a major diameter defining a major diameter surface, and a lower portion having a minor diameter defining a minor diameter surface;

a plunger head including a seal to sealingly engage a drain pipe when in a lowered position and to allow passage of fluid when in a raised position;

a plunger body coupled to the plunger head and configured to move with the plunger head between the lowered position and the raised position;

a lever arm operably coupled to the plunger body and configured to move the plunger body and the plunger head from the lowered position to the raised position;

a screen removably coupled to the plunger head and configured to block debris from passing into the drain pipe when the plunger head is in the raised position, the screen formed of a polymer and including an annular support collar having a split ring to frictionally engage an outer surface of the plunger head, and a plurality of circumferentially spaced fingers extending downwardly from the support collar, each of the plurality of fingers including an upper end coupled to the support collar, and a lower end freely suspended below the upper end and the support collar;

wherein each finger includes a length from the upper end to the lower end, the length being sufficient to vertically overlap with the minor diameter surface of the drain pipe when the plunger head is in both the lowered position and the raised position.

16. The drain stopper assembly of claim 15, wherein the lower ends of adjacent fingers are circumferentially spaced apart by 0.1 inches.

17. The drain stopper assembly of claim 15, wherein each finger includes a length from the upper end to the lower end of 0.6 inches.

18. The drain stopper assembly of claim 15, wherein the plunger body includes a plurality of fins, and the support collar includes a plurality of notches cooperating with the plurality of fins.

19. The drain stopper assembly of claim 15, wherein the support collar may be flexed open at a slot to facilitate installation and removal for the screen on the plunger head.

* * * * *